US008519808B2

(12) United States Patent
Morimura

(10) Patent No.: US 8,519,808 B2
(45) Date of Patent: Aug. 27, 2013

(54) ELECTROMAGNETIC RELAY

(75) Inventor: Masato Morimura, Tokyo (JP)

(73) Assignee: Fujitsu Component Limited, Tokyo (JP)

( * ) Notice: Subject to any disclaimer, the term of this patent is extended or adjusted under 35 U.S.C. 154(b) by 66 days.

(21) Appl. No.: 12/902,206

(22) Filed: Oct. 12, 2010

(65) Prior Publication Data

US 2011/0115586 A1 May 19, 2011

(30) Foreign Application Priority Data

Nov. 16, 2009 (JP) ..... 2009-261172

(51) Int. Cl.
*H01H 51/22* (2006.01)

(52) U.S. Cl.
USPC ..... 335/78; 335/80

(58) Field of Classification Search
USPC ..... 335/78
See application file for complete search history.

(56) References Cited

U.S. PATENT DOCUMENTS

| | | | | |
|---|---|---|---|---|
| 2,575,060 | A * | 11/1951 | Matthias | 218/25 |
| 4,404,443 | A * | 9/1983 | Coynel et al. | 218/23 |
| 5,546,061 | A * | 8/1996 | Okabayashi et al. | 335/78 |
| 5,757,255 | A * | 5/1998 | Noda et al. | 335/78 |
| 6,700,466 | B1 * | 3/2004 | Yamamoto et al. | 335/132 |
| 7,283,026 | B2 * | 10/2007 | Nakamura et al. | 335/78 |

FOREIGN PATENT DOCUMENTS

JP 2006-196372 7/2006

* cited by examiner

*Primary Examiner* — Elvin G Enad
*Assistant Examiner* — Lisa Homza
(74) *Attorney, Agent, or Firm* — IPUSA, PLLC

(57) ABSTRACT

An electromagnetic relay, includes a fixing contact; a movable contact configured to be moved to or from the fixing contact in an approaching and separating direction; a movable part; a driving part configured to drive the movable part; a pressing part configured to press the movable contact based on the driving of the movable part; and a magnetic body provided at an external periphery side of at least one of the fixing contact, the movable contact, and an air space in the approaching and separating direction of the fixing contact and the movable contact.

4 Claims, 11 Drawing Sheets

(a)

(b)

(a)

(b)

ELECTROMAGNETIC RELAY

CROSS-REFERENCE TO RELATED APPLICATIONS

This patent application is based upon and claims the benefit of priority of Japanese Patent Application No. 2009-261172 filed on Nov. 16, 2009, the entire contents of which are incorporated herein by reference.

BACKGROUND OF THE INVENTION

1. Field of the Invention

The present invention generally relates to electromagnetic relays. More specifically, the present invention relates to an electromagnetic relay configured to turn on or off electric power of an electrical device for home or industrial use.

2. Description of the Related Art

Under conditions where a voltage applied to a contact configured to perform opening and closing operations in an electromagnetic relay is high and an amount of an electric current flowing into the contact is large, when a fixing contact and a movable contact forming the contact become separated from each other from a state where the fixing contact and the movable contact come in contact with each other or when the fixing contact and the movable contact come in contact with each other from a state where the fixing contact and the movable contact forming the contact are separated from each other, an arc may be generated in a case where the voltage becomes greater than a minimum arc voltage or the electrical current becomes greater than a minimum arc electrical current.

The arc is a phenomenon where an electrical current flows in an air gap between surfaces of the fixing contact and the movable contact in a state where an electrical load is applied between the fixing contact and the movable contact. The arc starts when an electron moves from a cathode to an anode by flowing across the air gap. The electron collides with a molecule of air accompanying movement of the electron in the air gap so that ionization occurs. The electron reaches the anode so that the anode is heated. Thereby, a cation is discharged to the air gap from the anode. As a result of this, the cation collides with the cathode so that the cathode is heated.

Thus, heat generated at the anode and the cathode may cause evaporation of the molecules forming the anode and the cathode so that the wear at the surfaces of both the fixing contact and the movable contact may be increased. Accordingly, it may be required to inhibit the wear due to the arcing as much as possible. Such an electromagnetic relay configured to inhibit the wear due to the arcing has been suggested in, for example, Japanese Laid Open Patent Application Publication No. 2006-196372.

In the electromagnetic relay described in Japanese Laid Open Patent Application Publication No. 2006-196372, a characteristic of the arc which is the same as a magnetic characteristic of the electrical current is used. With this structure, by a magnetic flux due to a magnet provided at a movable spring which urges in a direction to separate the movable contact from the fixing contact, the arc can be bent and deflected. Hence, heating and the wear of the contact can be inhibited. However, in this structure, the arc is transferred to the movable spring. Therefore, this structure may cause the wear of the movable spring so that the opening and closing operations of the contact may be influenced. In addition, the magnetic flux of the magnet is fixed in a single direction. Therefore, in a case where the contact of an alternating current is opened or closed, since a direction of the arc is periodically changed, it may be, depending on a way of using the magnet, difficult to control the direction of the arc.

Here, in a case where the contact is opened or closed and the voltage and the electrical current are high, in order to increase durability against the wear of the contact, the volume of the contact may be increased; plural of the contacts may be provided; or the air gap between the contacts may be increased. As a result, the external dimensions of the electromagnetic relay may be increased so that the manufacturing cost may be increased.

SUMMARY OF THE INVENTION

Accordingly, embodiments of the present invention may provide a novel and useful electromagnetic relay solving one or more of the problems discussed above.

More specifically, the embodiments of the present invention may provide an electromagnetic relay whereby it is possible to inhibit wear of a contact without increasing manufacturing costs and influencing opening and closing capabilities.

Another aspect of the embodiments of the present invention may be to provide an electromagnetic relay, including:

a fixing contact;

a movable contact configured to be moved to or from the fixing contact in an approaching and separating direction;

a movable part;

a driving part configured to drive the movable part;

a pressing part configured to press the movable contact based on the driving of the movable part; and a magnetic body provided at an external periphery side of at least one of the fixing contact, the movable contact, and an air space in the approaching and separating direction of the fixing contact and the movable contact.

Additional objects and advantages of the embodiments are set forth in part in the description which follows, and in part will become obvious from the description, or may be learned by practice of the invention. The object and advantages of the invention will be realized and attained by means of the elements and combinations particularly pointed out in the appended claims. It is to be understood that both the foregoing general description and the following detailed description are exemplary and explanatory and are not restrictive of the invention as claimed.

According to the embodiments of the present invention, it is possible to provide an electromagnetic relay whereby it is possible to inhibit wear of a contact without increasing manufacturing costs and influencing opening and closing capabilities.

DETAILED DESCRIPTION OF THE PREFERRED EMBODIMENTS

A description is given below, with reference to the FIG. 1 through FIG. 11 of embodiments of the present invention.

[First Embodiment]

Figure 1:
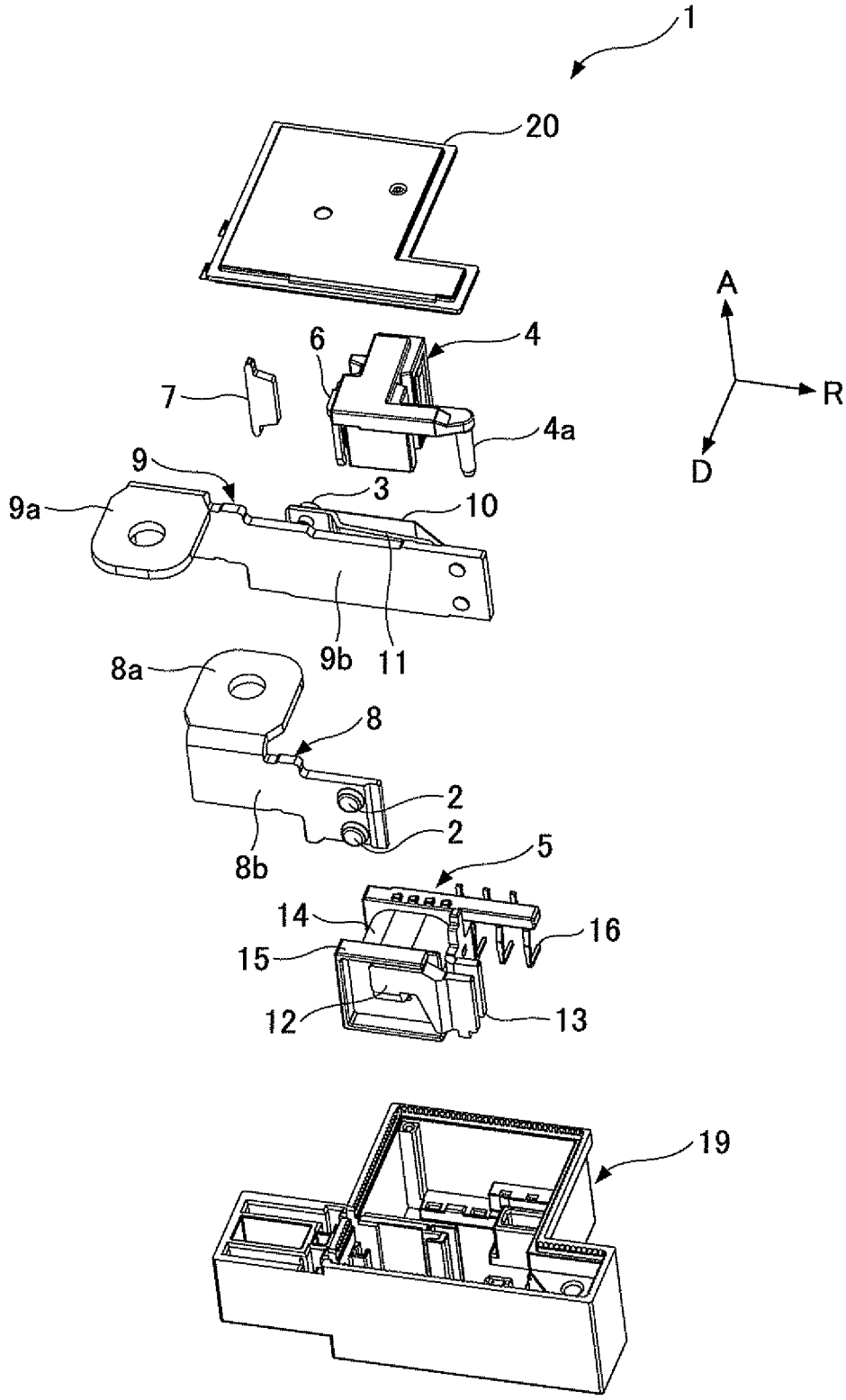
FIG. 1 is a first schematic, perspective, and exploded view of an electromagnetic relay of a first embodiment of the present invention.
Figure 2:
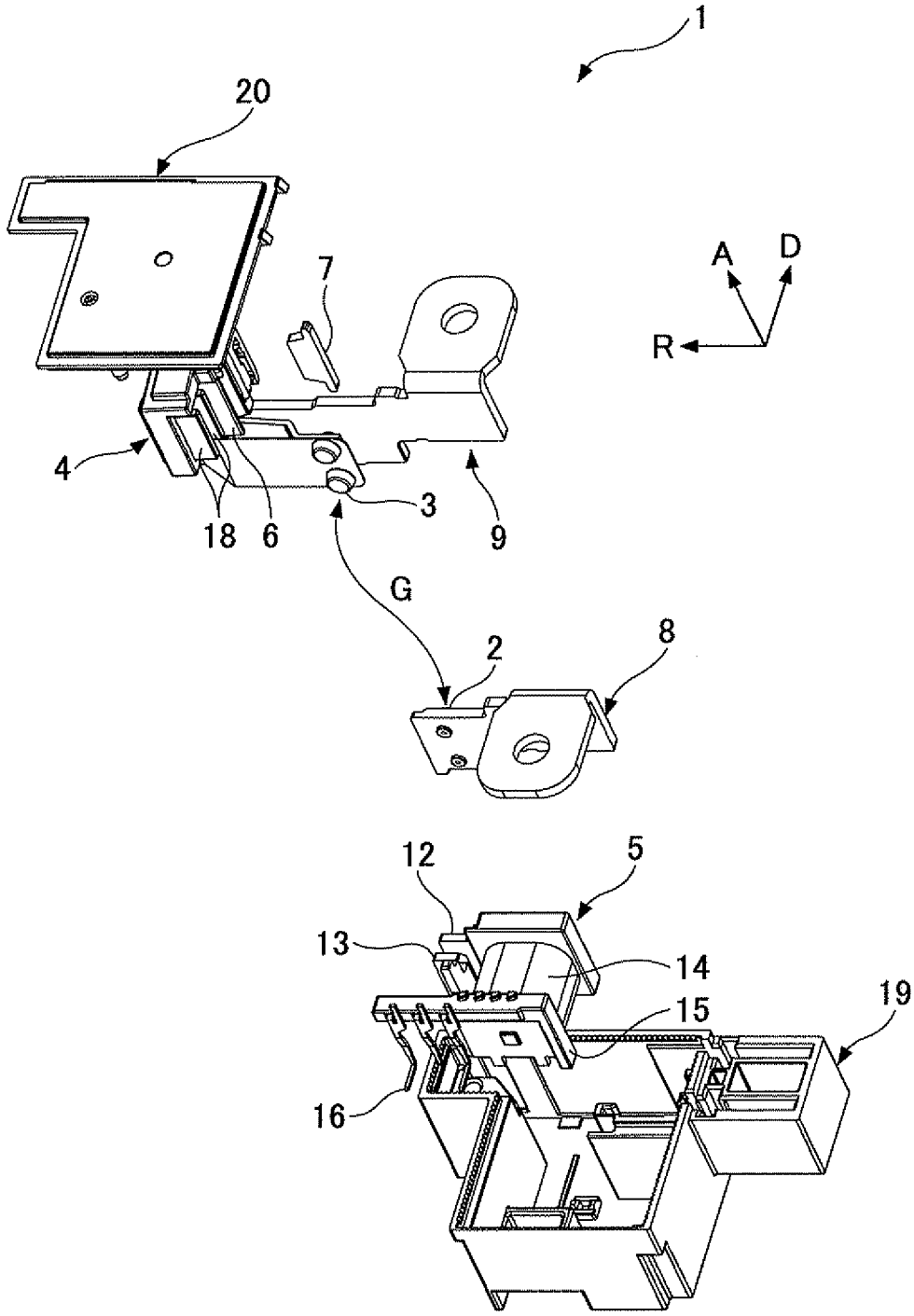
FIG. 2 is a second schematic, perspective, and exploded view of the electromagnetic relay of the first embodiment of the present invention.
Figure 3:
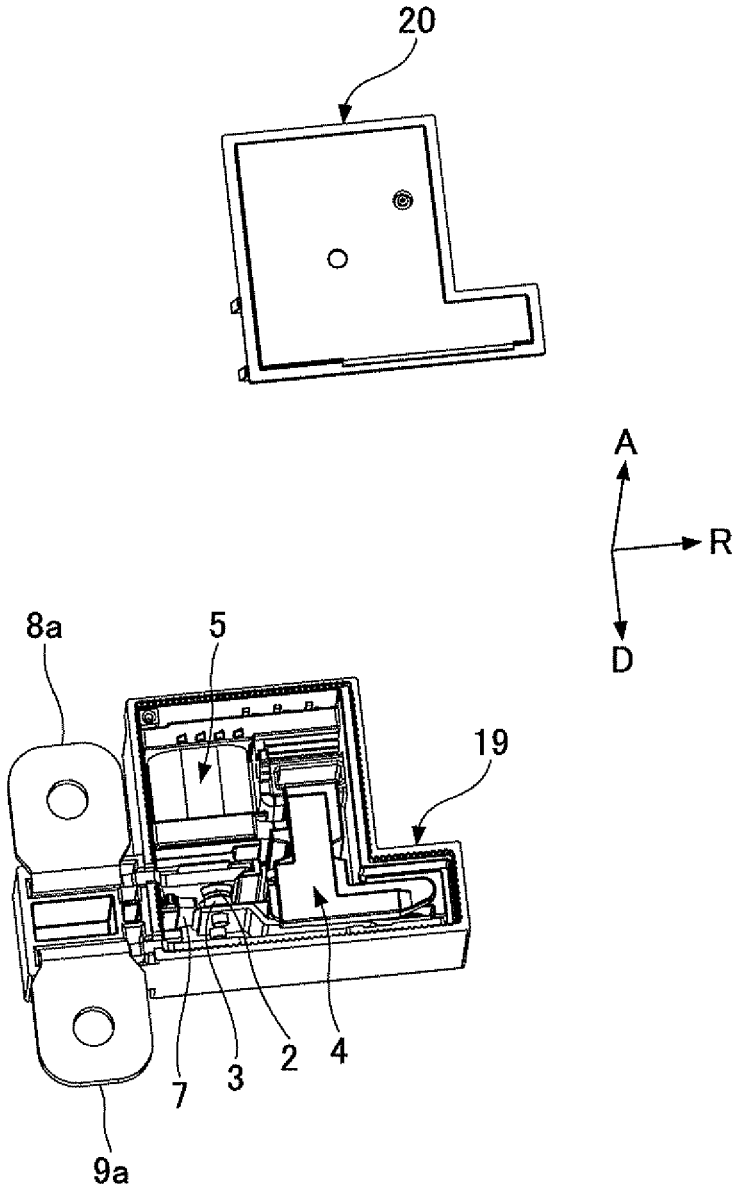
FIG. 3 is a third schematic, perspective, and exploded view of the electromagnetic relay of the first embodiment of the present invention.
Figure 4:
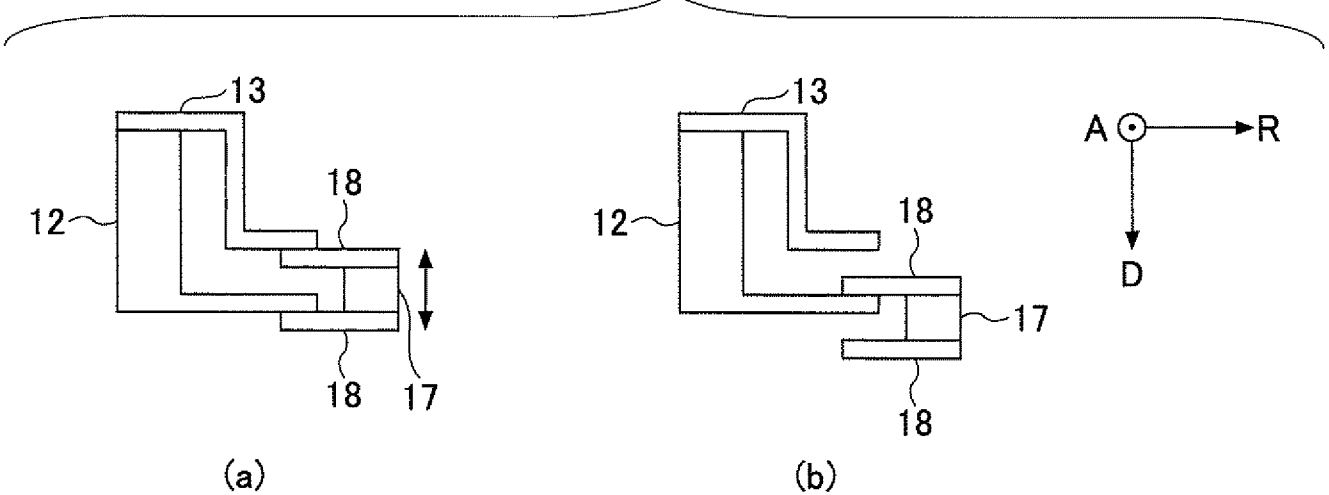
FIG. 4 is a schematic view showing a change of a mutual positional relationship and a contact arrangement of an iron core and a yoke and an armature.

FIG. 1 through FIG. 3 are first through third schematic, perspective, and exploded views of an electromagnetic relay of a first embodiment of the present invention. More specifically, FIG. 1 through FIG. 3 are schematic and perspective views showing an arrangement in a direction from a base to a cover of each of components of the electromagnetic relay of the first embodiment of the present invention. In drawings which are referred to in the following explanation, "A" denotes a direction from the base to the cover. "R" denotes an extending direction of a flat plate where a terminal part is a starting point of a movable contact side bus bar terminal. "D" denotes a separating direction of the movable contact configured to approach to or be separated from the fixing contact. The direction A, the extending direction R, and the separating direction D are perpendicular to each other. FIGS. 4(*a*) and 4(*b*) are schematic views showing a change of a mutual positional relationship and a contact arrangement of an iron core and a yoke and an armature of the electromagnetic relay of the first embodiment of the present invention.

An electromagnetic relay 1 of the first embodiment of the present invention includes, as illustrated in FIG. 1 and FIG. 2, a fixing contact 2, a movable contact 3, an actuator (movable part) 4, a driving part 5, a card (pressing part) 6, and an air gap side magnetic body (magnetic body) 7. The movable contact 3 can approach the fixing contact 2 in the approaching direction and can be separated from the fixing contact 2 in the separating direction. The driving part 5 is configured to drive the actuator 4 by an electromagnetic force. The card 6 is configured to press the movable contact 3 based on driving of the actuator 4. The air gap side magnetic body 7 is arranged at an external periphery part of at least one of the fixing contact 2, the movable contact 3, and an air space G illustrated in FIG. 2 in the approaching and separating directions of the fixing contact 2 and the movable contact 3.

In addition, the electromagnetic relay 1 includes a fixing side bus bar terminal 8 and a movable side bus bar terminal 9. The fixing side bus bar terminal 8 is electrically connected to the fixing contact 2. The movable side bus bar terminal 9 is electrically connected to the movable contact 3. The fixing side bus bar terminal 8 includes a terminal part 8*a* and a flat plate part 8*b*. The terminal part 8*a* forms a plane surface perpendicular to the direction A. The flat plate part 8*b* extends in the extending direction R and is perpendicular to the separating direction D. The movable side bus bar terminal 9 includes a terminal part 9*a* and a flat plate part 9*b*. The terminal part 9*a* forms a plane surface perpendicular to the direction A. The flat plate part 9*b* extends in the extending direction R and is perpendicular to the separating direction D.

Two of the movable contacts 3 are provided with a gap in the direction A. The movable contacts 3 are fixed, by caulking, at two holes provided at end parts of a bent flat plate-shaped movable spring 10 and a bent flat plate-shaped plain knitting line 11 situated in a direction opposite to the direction R, so as to be unified with the movable spring 10 and the plain knitting line 11. The unified movable contact 3, the movable spring 10, and the plain knitting line 11 are fixed, by rivets or the like (not illustrated), to an end part at a direction R side of the flat plate part 9*b* of the movable side bus bar terminal 9. The movable spring 10 urges the movable contact 3 to the fixing contact 2 in the separating direction D. The movable spring 10 receives a pressing force by the card 6 of the actuator 4 driven by the driving part 5 so as to transfer a force in the approaching direction opposite to the separating direction D to the movable contact 3.

In addition, two of the fixing contacts 2 are provided with a gap in the direction A. The fixing contacts 2 are fixed, by caulking, at two holes provided at end parts of the flat plate 8*b* of the fixing side bus bar terminal 8 situated in a direction opposite to the direction R, so as to be unified with the flat plate part 8*b*. The driving part 5 includes an iron core 12, a yoke 13, a coil 14, a bobbin 15, and control terminals 16 connected to the coil 14.

In addition, the actuator 4 includes a pair of armatures 18 (contact parts) shown in FIGS. 4(*a*) and 4(*b*) and FIG. 2. The pair of armatures 18 is configured to sandwich a permanent magnet 17 (see FIGS. 4(*a*) and 4(*b*)) in the separating direction D. Based on the driving of the actuator 4, the contact arrangement of the armatures 18 relative to the yoke 13 can be changed as illustrated in FIG. 4(*a*) and FIG. 4(*b*).

The iron core 12, the yoke 13, and the armatures 18 form a magnetic path in the electromagnetic relay 1 and are made of a semi-rigid magnetic material. The air gap side magnetic body 7 is made of the substantially same material as the semi-rigid magnetic material forming the iron core 12, the yoke 13, and the armatures 18.

A surface of the iron core 12 of the driving part 5 where the actuator 4 is attracted and an attracted surface of the actuator 4 are provided so as to face each other in the separating direction D. The flat plate part 8*b* of the fixing side bus bar terminal 8 and the flat plate part 9*b* of the movable side bus bar terminal 9 are provided so as to face each other in the separating direction D.

A main part including the driving part 5, the fixing side bus bar terminal 8, the movable side bus bar terminal 9, and the actuator 4 is received in a receiving space of a base (housing) 19 illustrated in FIG. 3 from a side opposite to the direction A so that the terminal part 8*a*, the terminal part 9*a*, and the control terminal 16 are exposed. The control terminal 16 is mounted on a surface side of the base 19.

In addition, a projecting part 4*a* of the actuator 4 is pivotally supported with respect to a shaft parallel with the direction A of a bearing part (not shown) in the receiving space of the base 19. The actuator 4 can be oscillated with respect to this shaft. The air gap side magnetic body 7 is held and fixed by a holder included in the base 19, which holder is not illustrated in FIG. 1 through FIG. 4(*b*). In this state, the cover 20 illustrated in FIG. 3 is installed from the direction A side of the receiving space of the base 19, so that the electromagnetic relay 1 is formed.

Figure 5:
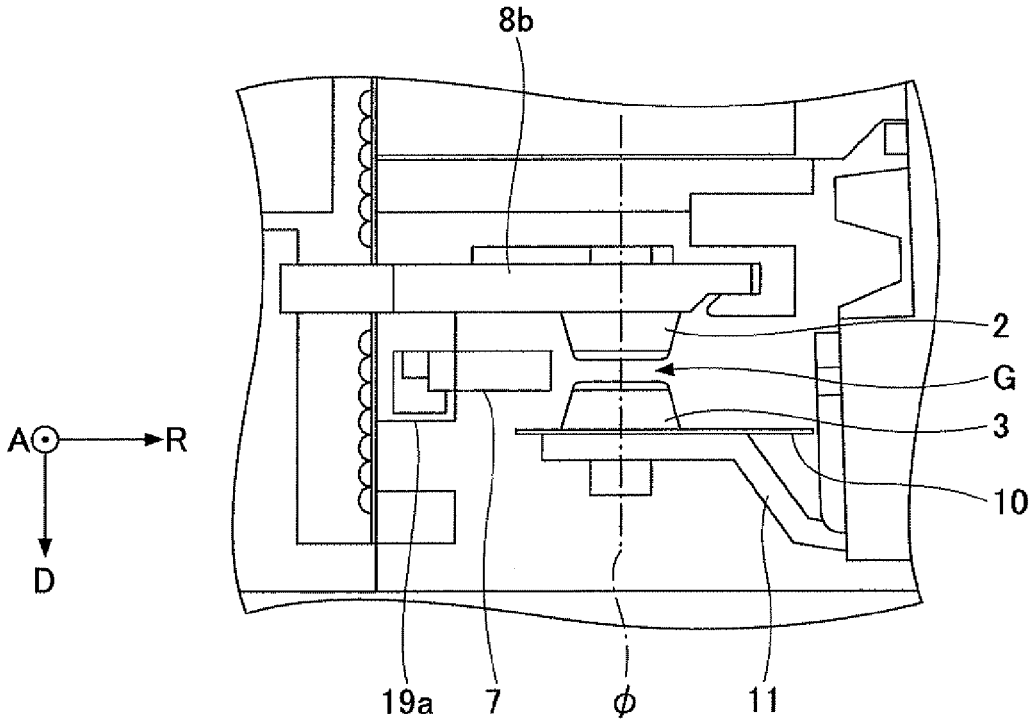
FIG. 5 is a schematic view showing the electromagnetic relay of the first embodiment of the present invention.

Next, details of a mutual relationship between the fixing contact 2, the movable contact 3, an air space G and the air space side magnetic body 7 are discussed with reference to FIG. 5. Here, FIG. 5 is a schematic view showing the electromagnetic relay 1 of the first embodiment of the present invention. More specifically, FIG. 5 is a schematic view showing a mutual relationship between the fixing contact 2, the movable contact 3, the air space G and the air space side magnetic body 7.

As illustrated in FIG. 5, the fixing terminal 2 is fixed to the flat plate part 8*b* of the fixing side bus bar terminal 8. The movable terminal 3 is fixed to the movable spring 10 and the plain knitting line 11. Each of the fixing terminal 2 and the movable terminal 3 has an umbrella-shaped configuration where a partial circular cone shape having a bottom and a lid and a cylindrical shape are combined. The cylindrical shaped part is attached by caulking. The partial circular cone shaped part forms a contact.

The fixing terminal 2 and the movable terminal 3 have a common central axial line Φ. The common central axial line Φ is parallel with the separating direction D. In an opening state which is other than a closing state where the contact is turned on by the fixing terminal 2 and the movable terminal 3 so that the electrical current flows, the fixing terminal 2 and the movable terminal 3 are separated from each other with the air space G on the common central axial line Φ.

The air space side magnetic body 7 is positioned in an external periphery side of the air space G and at an outside in a diameter direction of the common central axial line Φ. The air space side magnetic body 7 is formed so as to extend in the direction A and have a flat-shaped configuration perpendicular to the separating direction D. Ear parts (not shown) whose lengths in the extending direction R are short are formed at both end parts in the direction A of the air space side magnetic body 7. These ear parts are fixed to a holder 19*a* included in the base 19 by caulking.

The coil 14 includes a set coil and reset coil. In a case of an opening state where the contact formed by the fixing contact 2 and the movable contact 3 is opened, when a closing order signal is applied to the set coil from the control terminal 16, by an electromagnetic force in a direction where the actuator 4 is attracted, the electromagnetic force generated by the iron core 12 and the coil 14 of the driving part 5, the actuator 4 is attracted so as to be driven clockwise in FIG. 3. Based on the driving of the actuator 4, the movable spring 10 is pressed, by the card 6, in the approaching direction being opposite to the separating direction D, so that the movable contact 3 comes in contact with the fixed contact 2 to be in the closing state.

In a case of a closing state where the contact is closed, when an opening order signal is applied to the set coil from the control terminal 16, the electromagnetic force in a direction where the actuator 4 is attracted, the electromagnetic force being generated by the iron core 12 and the coil 14 of the driving part 5, is weakened. Therefore, the movable contact 3 is separated from the fixed contact 2 by an urging force in the separating direction D of the movable spring 10, so that the opening state is resumed.

In a case where the set coil and the reset coil of the coil 14 are not excited in the opening state and the closing state, the opening state or the closing state is maintained by residual flux of the iron core 12, the yoke 13, and the armatures 18 and a magnetic flux of the permanent magnet 17. In other words, the electromagnetic relay 1 of the first embodiment of the present invention is a polarized relay and a latch relay.

According to the electromagnetic relay 1 of the first embodiment of the present invention, the arc generated between the fixing contact 2 and the movable contact 3 is attracted to the air space side magnetic body 7, so that the arc generated from one of the fixing contact 2 and the movable contact 3 can be transferred to another of the fixing contact 2 and the movable contact 3 via the air space side magnetic body 7. Thus, by making the arc be attracted to an inside of the air space side magnetic body 7, electrical and thermal energy of the arc are attracted to the air space side magnetic body 7 so as to be reduced. Hence, an action where materials of the surfaces of the fixing contact 2 and the movable contact 3 are heated by the arc and evaporate is weakened so that wear of the material forming the contact can be inhibited as much as possible.

In addition, according to the electromagnetic relay 1 of the first embodiment of the present invention, there is no need to increase the volume or quantity of the fixing contact 2 and the movable contact 3 or make the air space G large. Hence, it is possible to avoid increasing the manufacturing cost.

In addition, by using the air space side magnetic body 7 which is a separate component relative to a main component forming the electromagnetic relay 1 as a member configured to attract the energy, it is possible to avoid influence on characteristics of the components contributing to the opening and closing operations of the electromagnetic relay 1. Hence, even if the subject of the opening and closing operations is a large amount of alternating current, it is possible to sufficiently inhibit the wear of the contact.

In addition, in a case where the subject of the opening and closing operations is a large amount of alternating current, a portion where the arc is generated or reaches moves between the fixing contact 2 and the movable contact 3 and an optional part of the fixing contact 2 and an optional part of the movable contact 3. However, according to the air space side magnetic body 7 which does not have a single direction polarity like a magnet, regardless of movement of a generation point and a reaching point of the arc, it is possible to attract the arc so that the energy can be reduced. Thus, even if the contact formed by the fixing contact 2 and the movable contact 3 is configured to open and close the contact for alternating current, it is possible to sufficiently and properly reduce the wear of the material forming the contact.

Furthermore, in the electromagnetic relay 1 of the first embodiment of the present invention, the arc is attracted by the air space side magnetic body 7 positioned at the external peripheral side of the air space G. Hence, the arc, generated in a case where the air space G is greater than a designated threshold value after the movable contact 2 is separated from the fixing contact 3 or before the movable contact 2 approaches the fixing contact 3 within a certain distance, can be effectively attracted by a shortest path using the air space side magnetic body 7 positioned at the external peripheral side of the air space G. Hence, the energy of the arc can be effectively attracted.

In addition, in the electromagnetic relay 1 of the first embodiment of the present invention, the actuator 4 includes a pair of the armatures 18 configured to sandwich the permanent magnet 17. The contact arrangement of the pair of the armatures 18 relative to the iron core 12 and the yoke 13 can be changed based on the driving by the driving part 5 of the actuator 4. Because of this, by using the permanent magnet 17, the magnetic paths in the iron core 12 and the yoke 13 can be properly changed between the closing state shown in FIG. 4(*a*) and the opening state shown in FIG. 4(*b*). As a result of this, the attracting force of the driving part 5 on the actuator 4 can be heightened so that the self-holding function can be attained.

Figure 6:
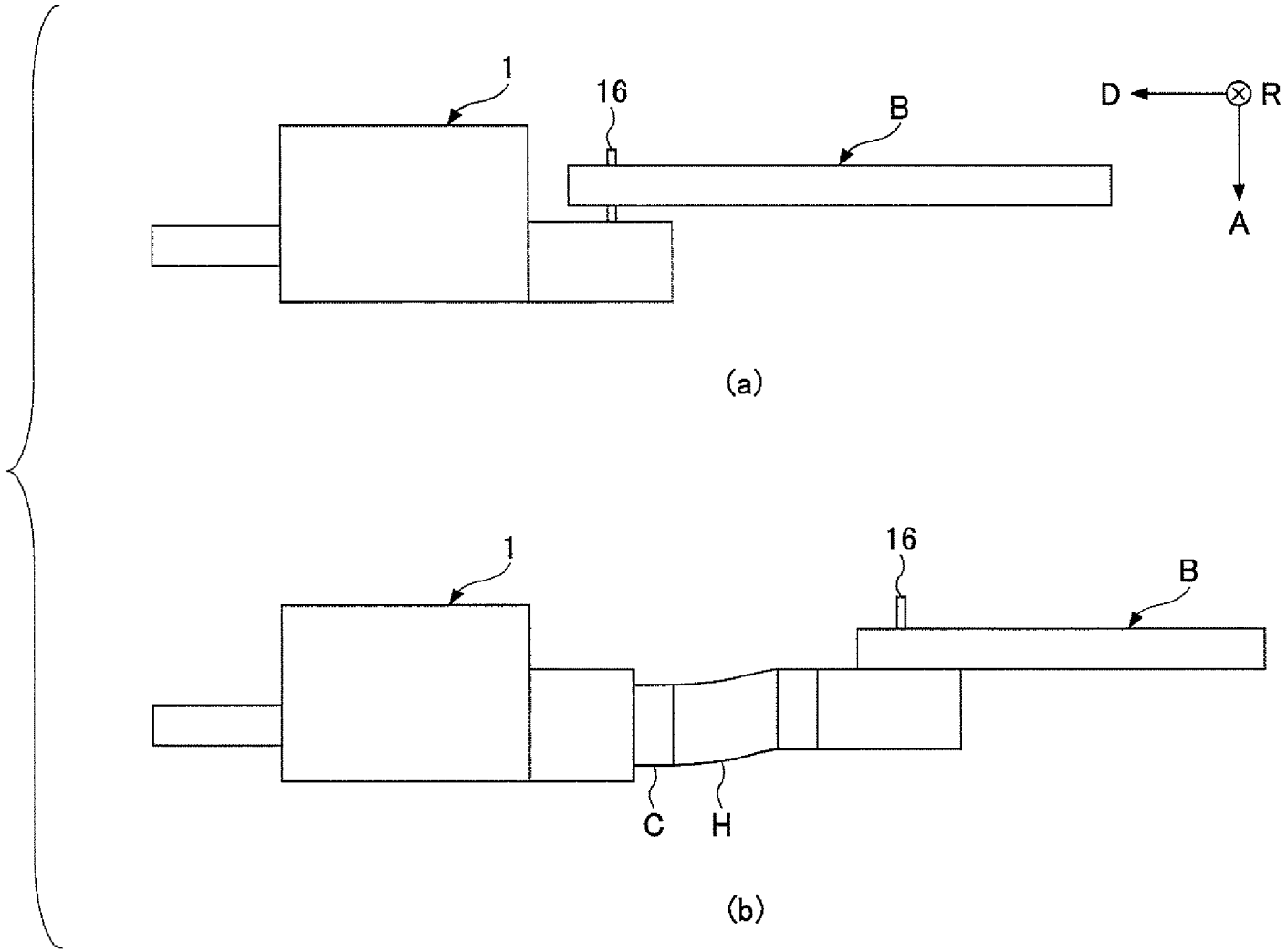
FIG. 6 is a schematic view showing a contact arrangement of the electromagnetic relay of the first embodiment of the present invention with a control board, based on comparison with a related art case.

In addition, the electromagnetic relay 1 of the first embodiment of the present invention includes the base 19 configured to hold the driving part 5 and the actuator 4. The control terminals 16 are provided at the surface side of the base 19. Hence, it is possible to achieve the effect as illustrated in FIGS. 6(*a*) and 6(*b*). Here, FIGS. 6(*a*) and 6(*b*) are schematic views showing a contact arrangement of the electromagnetic relay 1 of the first embodiment of the present invention with a control board B, based on comparison with a related art case.

In other words, the electromagnetic relay 1 of the first embodiment of the present invention, as illustrated in FIG. 6(*a*), can be directly mounted on the control board B. Because of this, compared to the related art illustrated in FIG. 6(*b*) where the electromagnetic board is connected to the control board B by a connector C and a harness H, the number of processes for connecting can be reduced so that connecting operations can be made easy.

In the electromagnetic relay 1 of the first embodiment of the present invention, the air space side magnetic body 7 provided at the external periphery of the air space G has a flat plate shaped configuration. However, a concave part may be provided at a side oriented toward the air space G. This structure is discussed in a second embodiment below.

[Second Embodiment]

Figure 7:
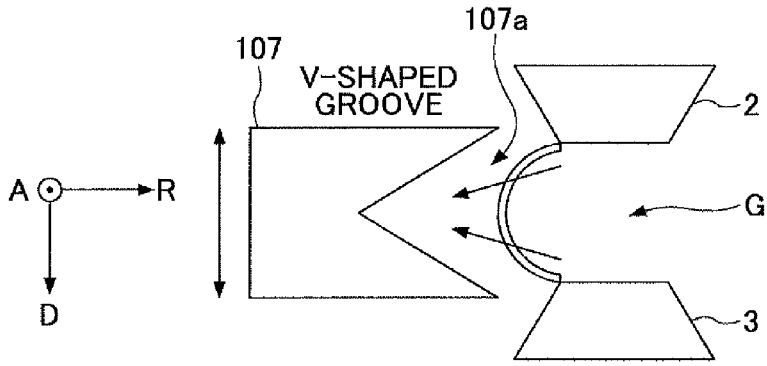
FIG. 7 is a schematic view showing an arrangement and configuration of a magnetic body and the way of attracting the arc of a second embodiment of the present invention.
Figure 7:
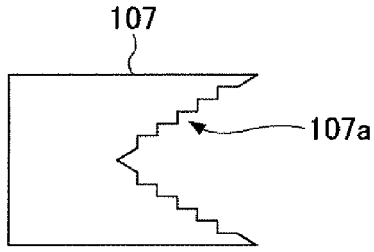

FIGS. 7(*a*) and 7(*b*) are schematic views showing the arrangement and configuration of a magnetic body 107 and the way of attracting the arc of a second embodiment of the present invention. In FIGS. 7(*a*) and 7(*b*), parts that are the same as the parts discussed in the first embodiment, other than a configuration of an air space side magnetic body 107, are given the same reference numerals, and explanation thereof is omitted.

In an electromagnetic relay of the second embodiment of the present invention, the air space side magnetic body 107 has, as illustrated in FIG. 7(*a*), a length which covers the entire length of the air space G formed by the fixing contact 2 and the movable contact 3 in the separating direction D. A concave part 107*a* which narrows toward the external periphery side is provided at a side facing the air space G. The length in the separating direction of the concave part 107*a* is linearly shorter as being toward the external periphery side. That is, the concave part 107*a* has a V-shaped groove cross-sectional configuration.

According to the electromagnetic relay of the second embodiment, the distance between the arc and the concave part 107*a* can be gradually longer from both ends to the center in the approaching and separating directions due to a structure where a length in the approaching and separating directions of the concave part 107*a* becomes shorter as being situated toward the external periphery side. Hence, it is possible to further develop an effect where the arc is attracted to the air space side magnetic body 107. In addition, a simple cutting process using, for example, a bit can be used as the process for manufacturing the concave part 107*a* so that the concave part 107*a* can be easily manufactured.

As illustrated in FIG. 7(*b*), the concave part 107*a* may have a configuration where the length of the separating direction D may be smaller in a step manner toward the external periphery side. With this structure, the external configuration of the concave part 107*a* may have a step-shaped configuration where a large number of sharp heads are provided. Hence, it is possible to improve the effect where the arc is attracted to the air space side magnetic body 107. Thus, it is possible to effectively inhibit the wear of the material forming the contact.

In the electromagnetic relays of the first and second embodiments, the air space side magnetic bodies 7 and 107 where the magnetic body is positioned at the external periphery side of the air space G are provided. A fixing side magnetic body positioned at an external periphery side of the fixing point 2 may be provided. This structure is discussed in a third embodiment below.

[Third Embodiment]

Figure 8:
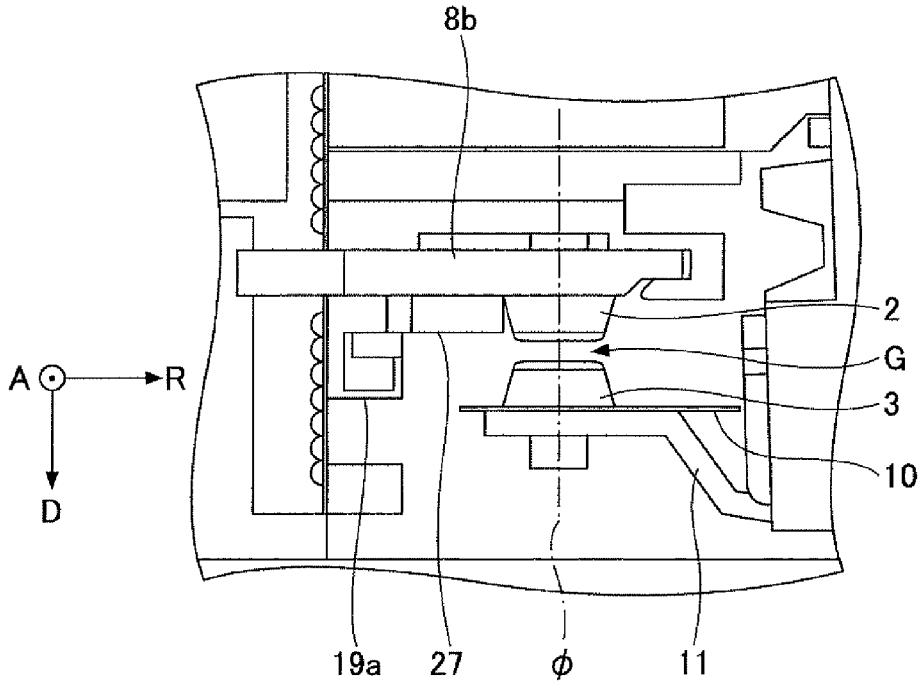
FIG. 8 is a schematic view showing an arrangement and configuration of a magnetic body and the way of attracting the arc of a third embodiment of the present invention.
Figure 8:
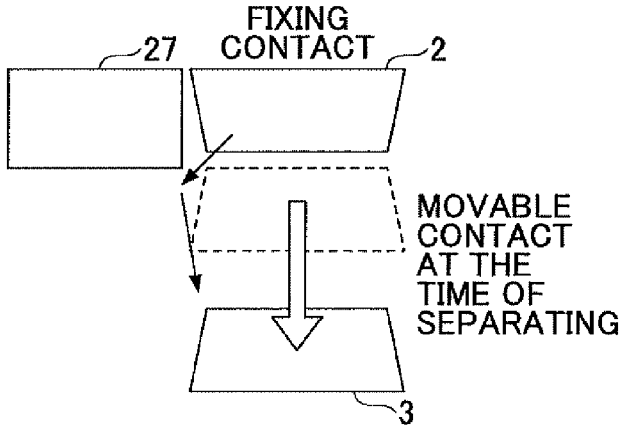

FIGS. 8(*a*) and 8(*b*) are schematic views showing an arrangement and configuration of a magnetic body and the way of attracting the arc of a third embodiment of the present invention. In FIGS. 8(*a*) and 8(*b*), parts that are the same as the parts discussed in the first embodiment, other than a fixing side magnetic body 27, are given the same reference numerals, and explanation thereof is omitted.

In an electromagnetic relay 1 of the third embodiment, as illustrated in FIG. 8(*a*), a fixing side magnetic body 27 positioned at an external periphery side of the fixing point 2 is provided. The fixing side magnetic body 27 is fixed to the flat plate part 8*b* of the fixing side bus bar terminal 8 by, for example, caulking, an adhesive, or the like.

In the meantime, in any of the first through third embodiments, a signal terminal configured to detect a conductive state between the fixing contact 2 and the movable contact 3 may be provided. This is discussed in a fourth embodiment below.

[Fourth Embodiment]

Figure 9:
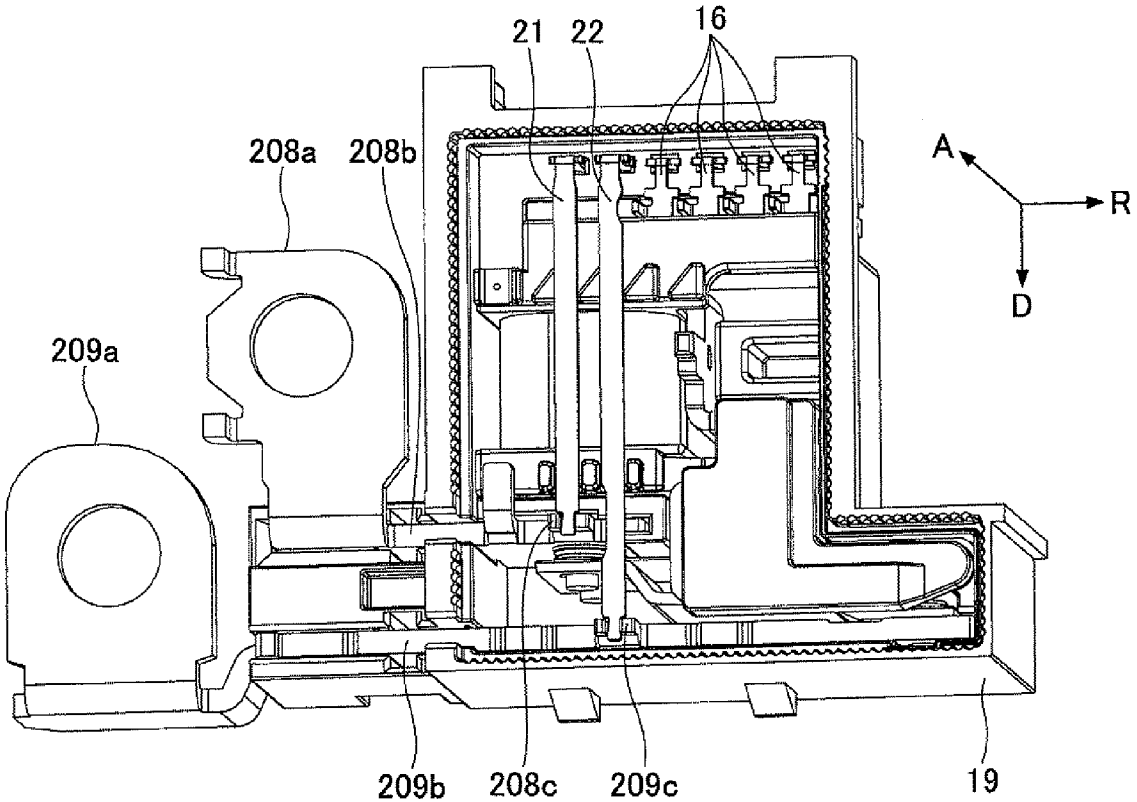
FIG. 9 is a schematic and perspective view of signal terminals and control terminals of an electromagnetic relay of a fourth embodiment of the present invention.
Figure 10:
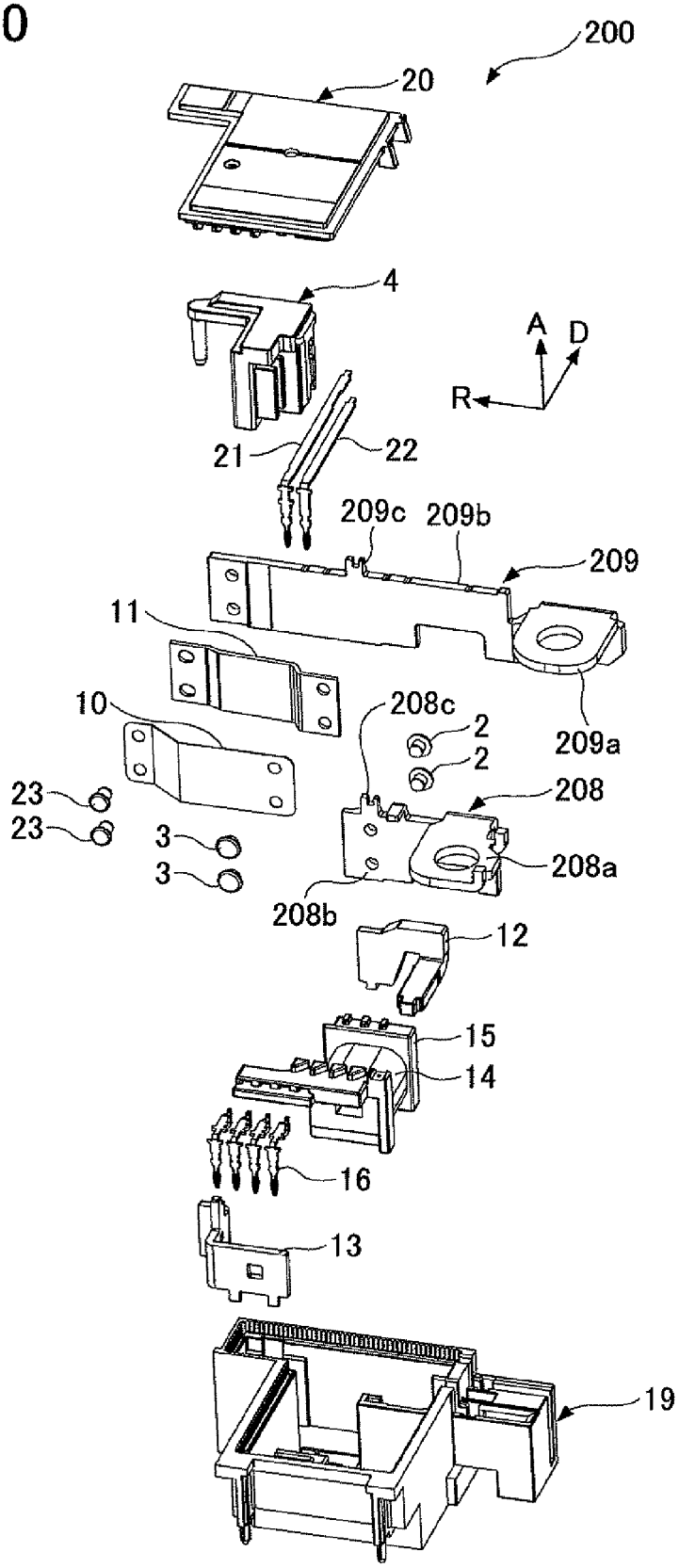
FIG. 10 is a schematic, perspective, and exploded view of an electromagnetic relay of the fourth embodiment of the present invention.
Figure 11:
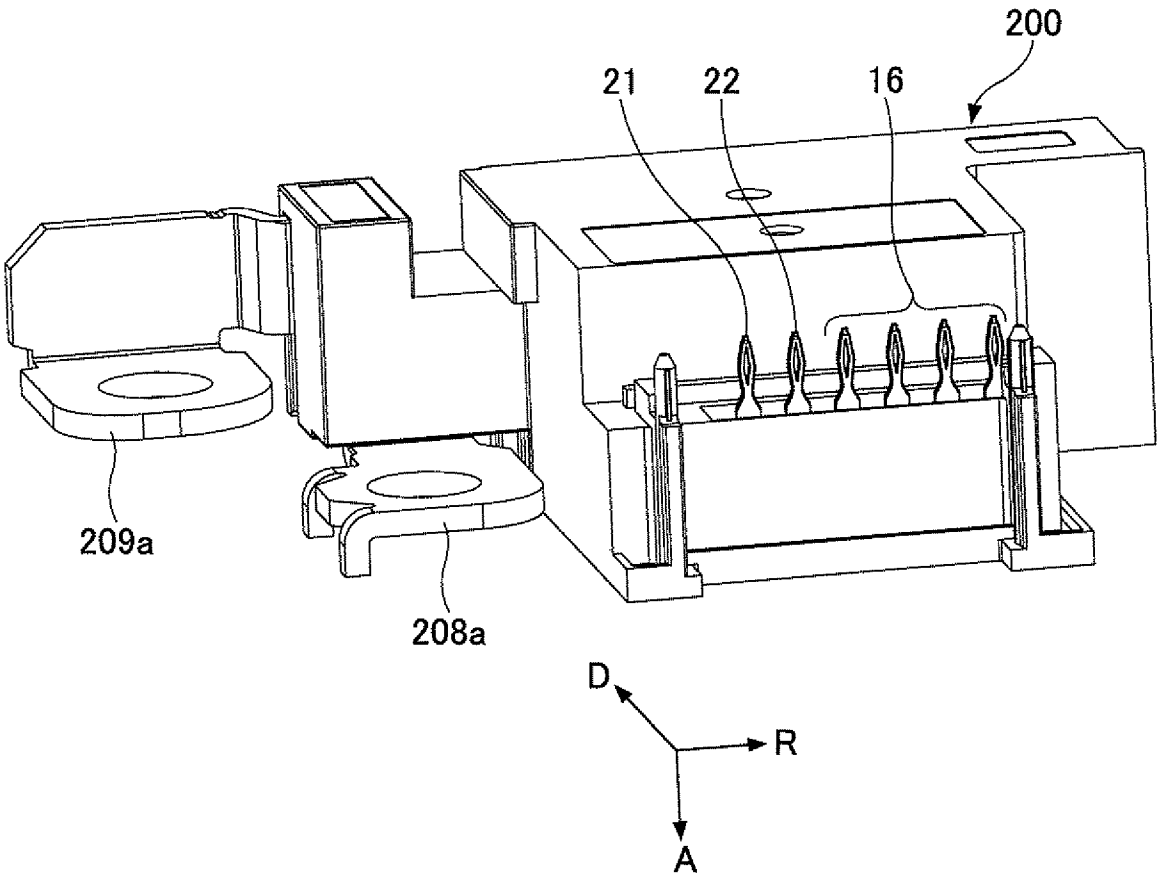
FIG. 11 is a schematic and perspective view of press-fit parts of the control terminals of the fourth embodiment of the present invention.

FIG. 9 is a schematic and perspective view of signal terminals and control terminals of an electromagnetic relay of a fourth embodiment of the present invention. FIG. 10 is a schematic, perspective, and exploded view of an electromagnetic relay of the fourth embodiment of the present invention. FIG. 11 is a schematic and perspective view of press-fit parts of the control terminals of the fourth embodiment of the present invention. In FIG. 9 through FIG. 11, parts are the same as the parts discussed in the first embodiment, other than that signal terminals 21 and 22 are added; rivets 23 configured to fix the movable spring 10 and the plain knitting line 11 are illustrated; and illustration of the air space side magnetic body 7 is omitted. Continued parts are given the same reference numerals, and explanation thereof is omitted.

In an electromagnetic relay 200 of the fourth embodiment of the present invention, a flat plate part 208*b* of a fixing side bus bar terminal 208 connected to the fixing contact 2 includes a projecting part 208*c* having a concave part. The projecting part 208*c* is configured to project in the direction A in FIG. 10. A flat plate part 209*b* of a movable side bus bar terminal 209 connected to the movable contact 3 includes a projecting part 209*c* having a concave part. The projecting part 209*c* is configured to project in the direction A in FIG. 10. In addition, the signal terminal 21 connected to the fixing side bus bar terminal 208 and the signal terminal 22 connected to the movable side bus bar terminal 209 are provided.

The signal terminal 21 extends in the separating direction D in FIG. 9. A convex part is formed at a side end part in the separating direction D of the signal terminal 21. The signal terminal 21 is fixed to, by caulking, and electrically connected to the concave part of the projecting part 208*c* of the fixing side bus bar terminal 208. The signal terminal 22 extends in the separating direction D in FIG. 9. A convex part is formed at a side end part in the separating direction D of the signal terminal 22. The signal terminal 22 is fixed to, by caulking, and electrically connected to the concave part of the projecting part 209*c* of the movable side bus bar terminal 209.

As shown in FIG. 9, the control terminals 16 are arranged in plural in the extending direction R. The signal contacts 21 and 22 are arranged in a direction opposite to the extending direction R. As illustrated in FIG. 11, the control terminals 16 and the signal terminals 21 and 22 project in a direction opposite to the direction A and have press-fit parts having a ring-shaped and eyeglass frame-shaped configuration.

According to the electromagnetic relay 200 of the fourth embodiment of the present invention, the conductive state between the fixing contact 2 and the movable contact 3 can be always monitored based on output signals of the signal terminals 21 and 22. In the electromagnetic relay 200 of the fourth embodiment of the present invention, the driving part 5 includes the iron core 12, the yoke 13, the coil 14, and the control terminals 16 connected to the coil 14. In addition, the control terminals 16 and the signal terminals 21 and 22 have the press-fit parts. Therefore, it is possible to easily connect the electromagnetic relay to an electronic device.

All examples and conditional language recited herein are intended for pedagogical purposes to aid the reader in understanding the invention and the concepts contributed by the inventor to furthering the art, and are to be construed as being without limitation to such specifically recited examples and conditions, nor does the organization of such examples in the specification relate to a showing of the superiority or inferiority of the invention. Although the embodiments of the present invention have been described in detail, it should be understood that the various changes, substitutions, and alterations could be made hereto without departing from the spirit and scope of the invention.

For example, the air space side magnetic body 7 or 107 of the first embodiment or the second embodiment may be properly combined with the fixing side magnetic body 27 of the third embodiment. Furthermore, in addition to the air space side magnetic body 7 or 107 of the first embodiment or the second embodiment or the fixing side magnetic body 27 of the third embodiment, a movable side magnetic body positioned at the external periphery side of the movable contact 3 may be provided.

The number of the control terminals 16 is three in the first embodiment and four in the fourth embodiment. In a case where cathode sides or anode sides of the set coil and reset coil of the coil 14 are made common, the number of the control terminals 16 is three. In a case where cathode sides or anode sides of the set coil and reset coil of the coil 14 are made individually, the number of the control terminals 16 is four. These numbers can be properly selected based on the freedom degree of the arrangement of the terminals.

The embodiments of the present invention are related to the electromagnetic relays. In the embodiments, the arc is attracted and its energy is attenuated so that the wear of the fixing contact and the movable contact can be inhibited. In addition, it is possible to prevent the wear of the movable spring or decrease of opening and closing capabilities, without causing increases in the external configuration and manufacturing costs of the electromagnetic relay. Because of this, the embodiments can be applied to the electric power of an electrical device for home or industrial use.

According to the embodiments of the present invention, it is possible to provide an electromagnetic relay, including a fixing contact; a movable contact configured to be moved to or from the fixing contact in an approaching and separating direction; a movable part; a driving part configured to drive the movable part; a pressing part configured to press the movable contact based on the driving of the movable part; and a magnetic body provided at an external periphery side of at least one of the fixing contact, the movable contact, and an air space in the approaching and separating direction of the fixing contact and the movable contact.

According to the electromagnetic relay of the embodiments, the arc generated between the fixing contact and the movable contact can be attracted to the magnetic body for a while. Until the arc is transferred from one of the fixing contact and the movable contact to another of the fixing contact and the movable contact, the arc can be transferred via the magnetic body. The energy of the arc can be electrically and thermally attracted to the magnetic body so as to be weakened. As a result of this, an action where the surfaces of the fixing contact and the movable contact are heated by the arc and evaporate is weakened so that wear of the material forming the contact can be inhibited as much as possible. By providing the magnetic body at not only a part but also the entire circumference in a circumferential direction at the external periphery side, it is possible to heighten the attraction force acting on the arc by making the attraction force be in a single direction.

In addition, according to this electromagnetic relay, there is no need to increase the volume or quantity of the fixing contact and the movable contact or make the air space large. Hence, it is possible to avoid increasing the manufacturing cost. In addition, since the magnetic body which is a separated component is used as a member configured to attract the energy, it is possible to avoid influence on characters of the components contributing to the opening and closing operations of the electromagnetic relay. Hence, even if the subject of the opening and closing operations is a large amount of an alternating current, it is possible to sufficiently inhibit the wear of the contact.

In addition, in a case where the subject of the opening and closing operations is a large amount of an alternating current, a portion where the arc is generated or reaches moves between the fixing contact and the movable contact and an optional part of the fixing contact and an optional part of the movable contact. However, regardless of movement of a generation point and a reaching point of the arc, it is possible to attract the arc so that the energy can be reduced. In other words, it is possible to provide a wear reducing method which is proper for opening and closing the contact for alternating current by the fixing contact and the movable contact.

The magnetic body may include a fixing side magnetic body positioned at the external periphery side of the fixing contact.

At a moment when the movable contact starts being separated from the fixing contact in the closing state where the movable contact comes in contact with the fixing contact, or just before a moment where the movable contact approaches in the opening state so as to come in contact with the fixing contact, the arc is generated. According to this electromagnetic relay, this arc is effectively attracted to the fixing side magnetic body situated at the external periphery side of the fixing contact, so that the energy of the arc can be effectively reduced.

The magnetic body may include an air space side magnetic body positioned at the external periphery side of the air space.

The arc, generated after the movable contact is separated from the fixing contact or before the movable contact approaches the fixing contact with a certain amount, can be effectively attracted by using the air space side magnetic body positioned at the external peripheral side of the air space. Hence, the energy of the arc can be effectively reduced.

The air space side magnetic body may include a concave part becoming narrowed toward the external periphery side; and a length of the concave part in the approaching and separating direction may become shorter as being situated toward the external periphery side.

Since a length in the approaching and separating direction of the concave part 107*a* is shorter as being situated toward the external periphery side, it is possible to improve the effect where the arc of the air space side magnetic body is attracted.

The concave part may include a V-shaped groove cross-sectional configuration.

With this structure, it is possible to improve the effect where the arc of the air space side magnetic body is attracted. In addition, it is possible to improve the process-ability of manufacturing of the concave part.

The length in the approaching and separating direction of the concave part may become shorter in a step manner as being situated toward the external periphery side.

Since an external configuration of the concave part has a step-shaped configuration where a large number of sharp head configurations are provided, it is possible to improve the effect where the arc of the air space side magnetic body is attracted.

The electromagnetic relay may further include a fixing side bus bar terminal connected to the fixing contact; a movable side bus bar terminal connected to the movable contact; and signal terminals connected to the fixing side bus bar terminal and the movable side bus bar terminal.

With this structure, the conductive state between the fixing contact and the movable contact can be always monitored by the signal terminals.

The driving part may include an iron core, a yoke, a coil, and a control terminal connected to the coil; and the control terminal and the signal terminals have press-fit parts.

With this structure, it is possible to easily connect the electromagnetic relay to the electronic device.

The movable part may include a pair of contact parts, the contact parts being configured to sandwich a permanent magnet; and a contact arrangement of the pair of the contact parts relative to the iron core and the yoke can be changed based on the driving of the movable part.

Thus, the embodiments can be applied to a polarized type latch relay where a magnetic path in the yoke and the iron coil is properly changed by using the permanent magnet so that the attracting force of the driving part to the movable part is improved and a self-holding activity is maintained.

The electromagnetic relay may further include a housing configured to hold the driving part and the movable part, wherein the control terminal may be provided at a surface side of the housing.

With this structure, it is possible to directly mount the electromagnetic relay on the control board.

What is claimed is:

1. An electromagnetic relay, comprising:

a fixing contact;

a movable contact configured to be moved to or from the fixing contact in an approaching and separating direction;

a fixed part having a surface, facing the movable contact in the approaching and separating direction, onto which the fixing contact is attached;

a movable part;

a driving part configured to drive the movable part;

a pressing part configured to press the movable contact based on the driving of the movable part; and a magnetic body having one portion being covered and held and another portion being uncovered, not contacting the fixing contact and directly exposed to an external periphery side of at least one of the fixing contact, the movable contact, and an air space between the fixing contact and the movable contact, wherein the magnetic body is sandwiched between the fixed part and the movable part.

2. The electromagnetic relay as claimed in claim 1, wherein the magnetic body includes a fixing side magnetic body positioned at the external periphery side of the fixing contact.

3. The electromagnetic relay as claimed in claim 1, wherein the magnetic body includes an air space side magnetic body positioned at the external periphery side of the air space.

4. The electromagnetic relay as claimed in claim 1, wherein the magnetic body overlaps a portion of the surface of the fixed part onto which the fixing contact is attached and a portion of a surface of the movable part onto which the movable contact is attached.

* * * * *